US012258113B2

(12) United States Patent
Neathery et al.

(10) Patent No.: US 12,258,113 B2
(45) Date of Patent: Mar. 25, 2025

(54) MARINE PROPULSION CONTROL SYSTEM WITH SYNCHRONIZED TROLL AND METHOD OF OPERATION

(71) Applicant: Caterpillar Inc., Peoria, IL (US)

(72) Inventors: Brian P. Neathery, Hockley, TX (US); Cameron S. Gandy, Houston, TX (US)

(73) Assignee: Caterpillar Inc., Peoria, IL (US)

( * ) Notice: Subject to any disclaimer, the term of this patent is extended or adjusted under 35 U.S.C. 154(b) by 707 days.

(21) Appl. No.: 17/383,571

(22) Filed: Jul. 23, 2021

(65) Prior Publication Data

US 2023/0028865 A1 Jan. 26, 2023

(51) Int. Cl.
*B63H 21/21* (2006.01)
*B63H 23/28* (2006.01)

(52) U.S. Cl.
CPC ..... *B63H 21/213* (2013.01); *B63H 23/28* (2013.01); *B63H 2021/216* (2013.01)

(58) Field of Classification Search
CPC ..... B63H 21/213; B63H 23/28; B63H 2021/216; B63H 21/21; B63H 23/30
See application file for complete search history.

(56) References Cited

U.S. PATENT DOCUMENTS 3,422,831 A 1/1969 Straney
4,836,809 A * 6/1989 Pelligrino ..... B63H 21/22 440/86
5,538,449 A * 7/1996 Richard ..... B63H 21/213 440/86
6,752,670 B2 6/2004 Geil
8,190,317 B2 5/2012 Kim
8,315,750 B2 11/2012 Blanke
9,784,323 B2 10/2017 Gallato
10,507,898 B1 * 12/2019 Belter ..... B63H 21/213
10,794,474 B1 * 10/2020 Bielefeld ..... F16H 61/0213
(Continued)

FOREIGN PATENT DOCUMENTS

CN 110120771 A 8/2019
JP 4707362 B2 6/2011
JP 5951587 B2 7/2016

OTHER PUBLICATIONS

Written Opinion and International Search Report for Int'l. Patent Appln. No. PCT/US2022/036203, mailed Nov. 23, 2022 (11 pgs).

*Primary Examiner* — Cao H Nguyen

(57) ABSTRACT

A marine vessel includes a hull, an operator station having an operator interface configured to receive a mode input and a lever position input, a left propulsion system, a right propulsion system, and a control module. Each of the propulsion systems includes an engine, a transmission, a troll valve configured to adjust clutch slip, a shaft, a shaft speed sensor configured to detect the speed of rotation of the shaft, and a propeller. The control module is configured to receive the mode input and the lever position input from the operator interface, receive signals from the left shaft sensor indicating a left shaft speed, receive signals from the right shaft sensor indicating a right shaft speed, determine if the vessel is operating in a trolling state, and determine if a sync mode is active, based on the mode input. If the sync mode is active and the vessel is in a trolling state, the speed of the left shaft and the right shaft are synchronized.

14 Claims, 7 Drawing Sheets

(56) References Cited

U.S. PATENT DOCUMENTS

| | | | | |
|---|---|---|---|---|
| 11,753,132 | B1 * | 9/2023 | Nakayasu | B63H 20/12 701/21 |
| 2008/0166932 | A1 * | 7/2008 | Kado | B63H 21/213 440/1 |

* cited by examiner

MARINE PROPULSION CONTROL SYSTEM WITH SYNCHRONIZED TROLL AND METHOD OF OPERATION

TECHNICAL FIELD

The present disclosure relates generally to marine propulsion control systems, and more specifically to systems with synchronization.

BACKGROUND

Marine vessels may be used in a variety of applications to provide transportation in waterways, such as oceans, lakes, rivers, and/or the like. Some of these marine vessels may include two propulsion systems positioned relative to the port and starboard sides of the vessel, and each of which may be independently controlled using corresponding port and starboard levers located at an operator station.

When the operator needs the two propulsion systems to provide the same thrust, a control system may allow for both propulsions system outputs to be synchronized and controlled by a single lever. This may be done by synchronizing the engine speeds to the lever position.

At very low speeds where fine speed control is desirable, particularly when fishing by trolling or maneuvering near shore or obstacles, a troll mode may be utilized in which the engine speed remains constant at idle or a low set point. The vessel speed may then be controlled by permitting varying amounts of clutch slippage to reduce the amount of power transferred from the engine to the propeller shaft. However, if synchronization and trolling are needed at the same time, the engine speed cannot be used to control the thrust from each system.

Some marine vessels include control systems which allow for synchronized control of more than one propulsion system; for example, as described in U.S. Pat. No. 6,751,533 to Graham et al. Graham teaches a marine propulsion control system in which a master control arm controls the throttle of a master engine and a second engine is commanded to produce the same throttle. However, because this system controls the engine speed, it cannot be used during a troll mode with a constant engine speed. Therefore, there remains a need for a system and method of synchronized engine control during trolling operations.

SUMMARY OF THE DISCLOSURE

According to one aspect of the present disclosure, a marine vessel is disclosed. The vessel includes a hull, an operator station having an operator interface configured to receive a mode input and a lever position input, a left propulsion system, a right propulsion system, and a control module. Each of the propulsion systems includes an engine, a transmission, a troll valve configured to adjust clutch slip, a shaft, a shaft speed sensor configured to detect the speed of rotation of the shaft, and a propeller. The control module is configured to receive the mode input and the lever position input from the operator interface, receive signals from the left shaft sensor indicating a left shaft speed, receive signals from the right shaft sensor indicating a right shaft speed, determine if the vessel is operating in a trolling state, and determine if a sync mode is active, based on the mode input. If the sync mode is active and the vessel is in a trolling state, the speed of the left shaft and the right shaft are synchronized.

According to another aspect of the present disclosure, a marine propulsion control system is disclosed. The system includes an operator interface configured to receive a mode input and a lever position input, a left propulsion system, a right propulsion system, and a control module. Each of the propulsion systems includes an engine, a transmission, a troll valve configured to adjust clutch slip, a shaft, a shaft speed sensor configured to detect the speed of rotation of the shaft, and a propeller. The control module is configured to receive the mode input and the lever position input from the operator interface, receive signals from the left shaft sensor indicating a left shaft speed, receive signals from the right shaft sensor indicating a right shaft speed, determine if the vessel is operating in a trolling state, and determine if a sync mode is active, based on the mode input. If the sync mode is active and the vessel is in a trolling state, the speed of the left shaft and the right shaft are synchronized to the lever position.

According to yet another aspect of the present disclosure, a method of operating a marine propulsion control system is disclosed. The method includes receiving a plurality of signals from an operator interface, the plurality of signals including a mode input and a lever position, receiving a 'left shaft speed' signal indicating a left shaft speed and a 'right shaft speed' signal indicating a right shaft speed, determining if a sync mode is active based on the mode input signal, and determining if a trolling state exists based on the mode input and the lever position. If a sync mode is active and a trolling state exists, synchronizing the left shaft speed and the right shaft speed to the lever position.

These and other aspects of the present disclosure will be more readily understood after reading the following detailed description in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
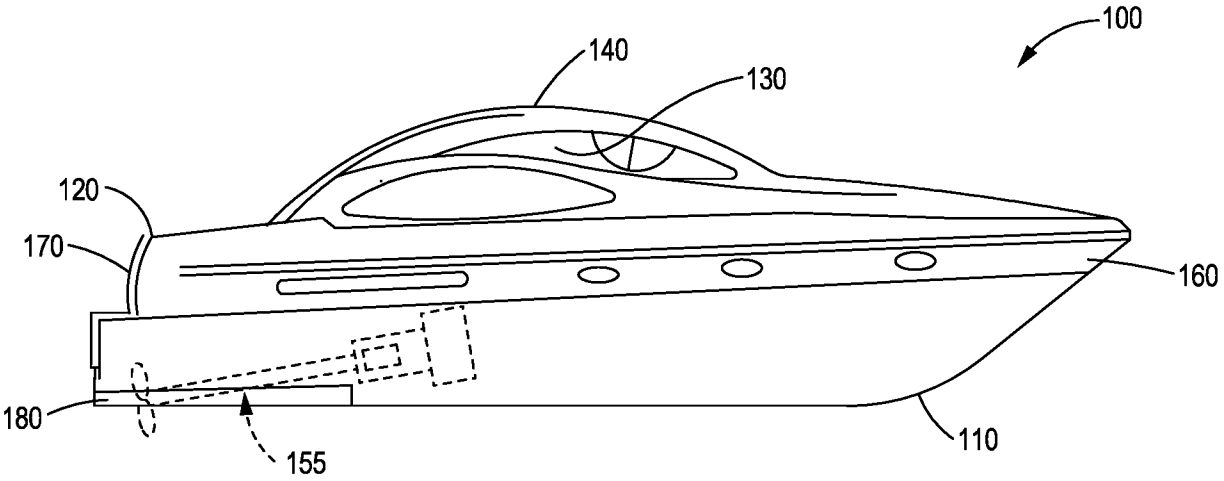
FIG. 1 is a side view of a marine vessel, according to one aspect of the present disclosure.
Figure 2:
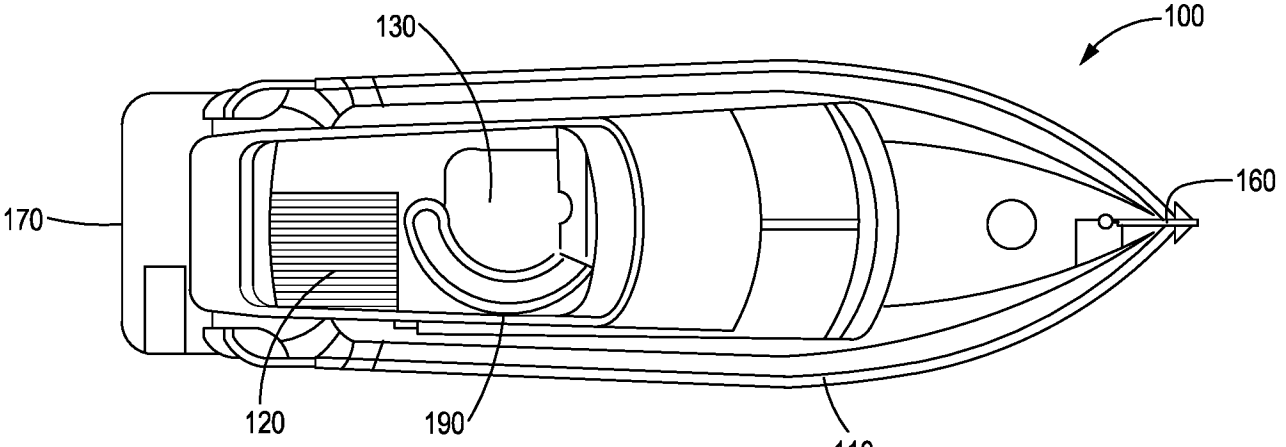
FIG. 2 is a top view of the marine vessel of FIG. 1, according to one aspect of the present disclosure.

Referring now to the drawings and with specific reference to FIGS. 1 and 2, an exemplary marine vessel is shown and referred to by reference numeral 100.

The exemplary marine vessel 100, as illustrated, may be a dual-engine power boat, although the term "marine vessel" may refer to any multi-engine marine vessel that performs an operation associated with for example, recreation, fishing, transportation, and the like. For example, the marine vessel 100 may be a supply boat, a tug boat, a sail boat (with a marine propulsion system), a hovercraft, an amphibious vehicle, a submarine, or another type of vehicle that is capable of traversing a waterway, such as an ocean, lake, canal, or river.

Figure 4:
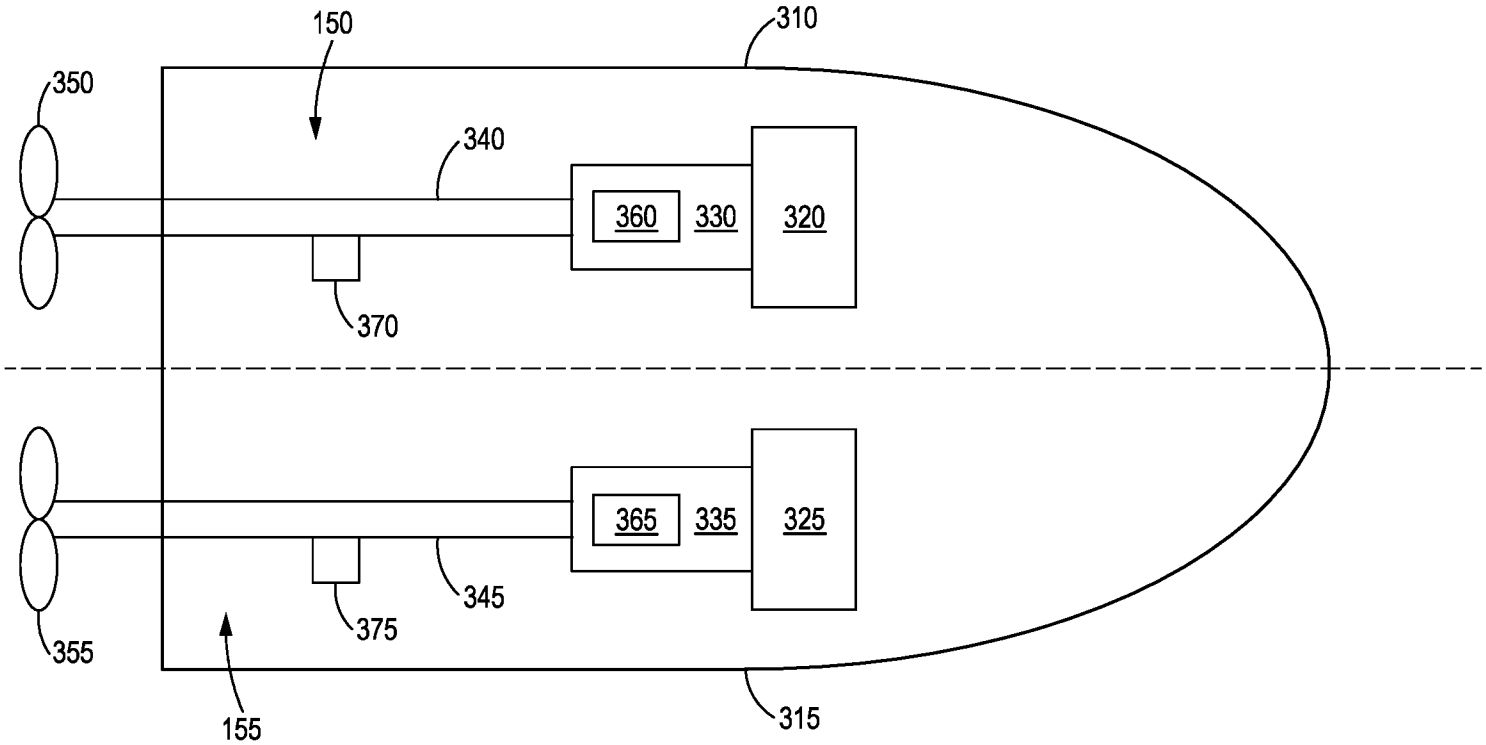
FIG. 4 is a top view diagram of the propulsion systems of the marine vessel of FIG. 1, according to one aspect of the present disclosure.

The marine vessel 100 may include a hull 110, a deck 120, an operator station 130, a left propulsion system 150, and a right propulsion system 155 (see FIG. 4). The hull 110 is the main body of the vessel 100 and has a stern 160 at the front in the usual direction of travel, and a bow 170 at the rear. The deck 120 is supported by the hull 110, and the operator station 130 is supported by the deck. The operator station may be enclosed by a bridge 140. Each of the left and right propulsion systems 150,155 are located within the hull 110 and project through the hull 110 near the bow 170 to provide thrust to the vessel 100. The vessel 100 may also include a steering mechanism 180 such as a rudder. Alternatively, steering may be provided by the propulsion systems.

Figure 3:
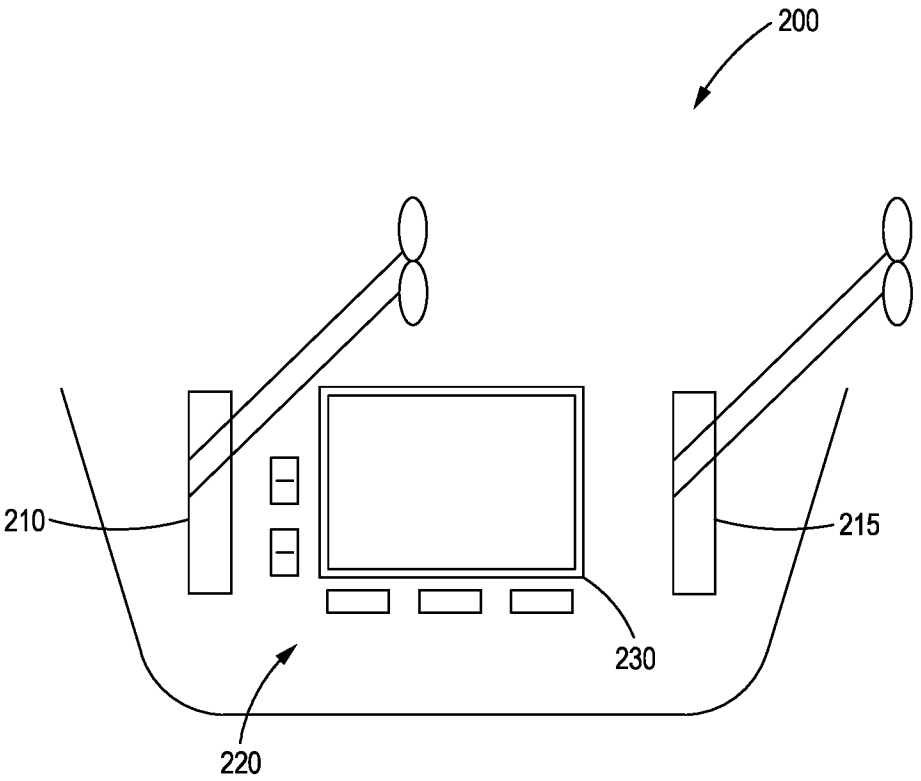
FIG. 3 is a diagram of one embodiment of an operator interface, according to one aspect of the present disclosure

The operator station 130 may be centrally located along a longitudinal axis from bow 160 to stern 170 and positioned such that an operator is facing the bow 160 during use of the operator station 130. The operator station 130 may optionally include a seat 190. In larger vessels 100, there may be multiple operator stations. The operator station 130 includes an operator interface 200 allowing an operator to control the systems of the vessel 100. One possible embodiment of the operator interface is shown in FIG. 3, but of course other layouts and components may be used.

The operator interface 200 includes a left control lever 210, a right control lever 215, and a mode input device 220. Each lever 210, 215 has possible lever positions of 0-100% and may optionally allow for reverse positions. The mode input device 220 is configured to indicate which of several control modes may be required. The mode input device 220 may be any combination of touch screen, switches, buttons, displays, or any other means of making a selection. The control modes are discussed in more detail in following sections.

The interface 200 may also include a display screen configured to visually indicate operating conditions, active modes, and/or warnings. The display screen may be the same device as the mode input device 220, or a separate component. The operator interface 200 may also include other input devices (not shown) including but not limited to a steering device such as a wheel or joystick.

The operator interface 130 is configured to produce a variety of signals in response to operator actions. In particular, the interface is configured to produce a 'mode input' signal, a 'left lever position' signal, and a 'right lever position' signal.

The left and right propulsion systems 150, 155 provide thrust to maneuver the vessel 100. In some embodiments, the vessel 100 may additionally include ancillary thrust systems to aid in maneuvering. FIG. 4 shows a diagram of the propulsion systems 150, 155 located within the vessel 100. The left propulsion system 150 is located generally to a left (port) side 310 of the vessel 100 and the right propulsion system is located to the right (starboard) side 315.

The left propulsion system 150 includes a left engine 320, a left transmission 330, a left shaft 340, and a left propeller 350. The engine 320 is located inside the hull 110 and drives the rotation of the shaft 340 via the transmission 330. The left shaft 340 runs substantially parallel to the longitudinal axis of the vessel 100 and is positioned to extend through the hull 110 towards the stern 170. The shaft 340 is connected to the propeller 350, or other similar propulsion device, outside the hull 110 so that the rotation of the propeller 350 can provide forward thrust for the vessel 110. The left transmission 330 includes a left troll valve 360. The left shaft 340 includes a shaft speed sensor 370 configured to measure the rotational speed of the left shaft 340 and produce a 'left shaft speed' signal.

The right propulsion system 155 is equivalent to the left 150 and as such includes a right engine 325, a right transmission 335, a right shaft 345, and a right propeller 355. The right transmission includes a right troll valve 365. The right shaft 345 includes a shaft speed sensor 375 configured to measure the rotational speed of the right shaft 345 and produce a 'right shaft speed' signal.

Each of the engines 320, 325 may be may be configured in a variety of ways. Typically, the engine 320, 325 will be diesel, but any suitable power source capable of driving the propulsion devices may be used. The size and configuration of the power source may also vary in different embodiments. In some embodiments, the engine may be a diesel engine with an idle speed of 700 rpm and a top speed of 2400 rpm.

Each of the transmissions 330, 325 includes a multiple-disk type clutch 380, 385 cooled and lubricated by oil. In the clutch 380, disks (not shown) are pressed together by a piston with pressurized oil providing the force necessary to create enough friction between the disks to prevent slippage. In this non-slipping mode, friction between the disks is transmitting 100% of the input power. The amount of engagement of the clutches 380 can optionally be controlled by the trolling valves 360, 365, where engagement can range from not engaged (100% slip) to fully engaged (0% slip). The left and right troll valves 360, 365 are adjustable pressure-regulating valves in the oil system of the transmission that allow the oil pressure to be regulated from 0 to full operating pressure. When the pressure is reduced, slippage occurs between the disks. Control over slip results in control over the resulting speed of the propellers as more or less rotational power from the engine is transmitted to the propeller shaft. Therefore, a higher percentage of slip leads to lower propeller speeds (and thus lower boat speeds), and a lower percentage of slip leads to greater propeller speeds (and thus greater boat speeds). The troll valves should only be used to create clutch slippage at low engine speeds. At higher speeds, the low oil pressure can cause overheating and damage to the transmission.

Figure 5:
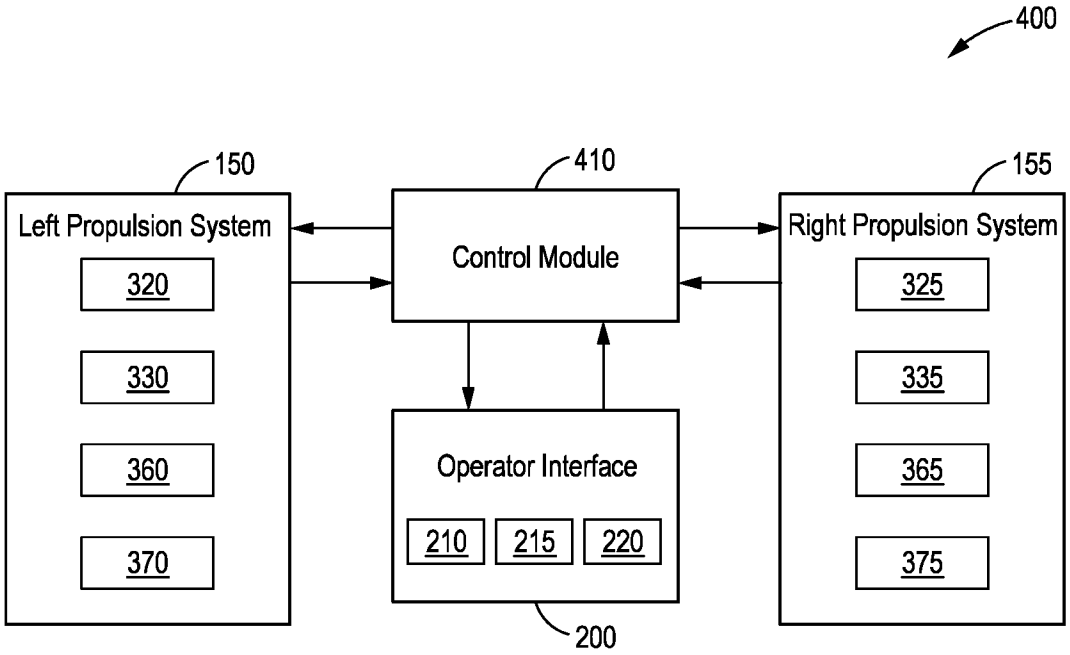
FIG. 5 is a block diagram of a marine propulsion control system, according to one aspect of the present disclosure.

The vessel 100 further includes a marine propulsion control system 400, as shown in FIG. 5. The control system 400 incorporates the operator interface 200 and propulsion systems 150, 155 previously described and further includes a control module 410. The control module 410 is configured to receive signals from the operator interface 200. In particular, the control module 410 receives a 'left lever position,' a 'right lever position,' and a 'mode input' from the interface 200. The control module 410 may also command the operator interface 200 to display operating parameters, active modes, and warnings as needed.

The control module 410 is further configured to receive signals from the propulsion systems 150, 155 indicating operational parameters. In particular, the control system 410 receives a 'right shaft speed' and a 'left shaft speed' from the shaft speed sensors on each propulsion system. The control system 410 is also configured to adjust the engine speed and the position of the troll valve 360, 365 of each propulsion system. In some embodiments, the control module 410 may interface directly with the propulsion systems 150, 155. In other embodiments, the control module 410 may interface with a left and right auxiliary control module (not shown) which in turn interface with the propulsion systems 150, 155.

In addition, the propulsion control system 410 is configured to operate the vessel 100 in several different operational modes, including, but not necessarily limited to, a 'traditional troll' mode, an 'advanced troll' mode, and a 'normal' mode in which no other modes are activated. In addition, a 'sync' mode may be active simultaneously with the other modes. Other modes may be possible but are not relevant to the present disclosure.

In 'normal' operation, the position of the left or right control lever 210, 215 is used to control the engine speed of the corresponding propulsion system 150, 155. A lever position of 0% corresponds to the idle speed of the engine while 100% corresponds to maximum throttle.

At very low speeds where fine speed control is desirable, particularly when fishing by trolling or maneuvering near shore or obstacles, the 'traditional troll' and 'advanced troll' modes may be utilized. These modes allow for the vessel 100 to be operated in a 'trolling state.' In a 'trolling state', the engine speed remains either constant or at a low speed. The shaft speed may then be controlled by adjusting the troll valve 360, 365 to create clutch slippage and therefore lower propeller speeds.

Figure 6:
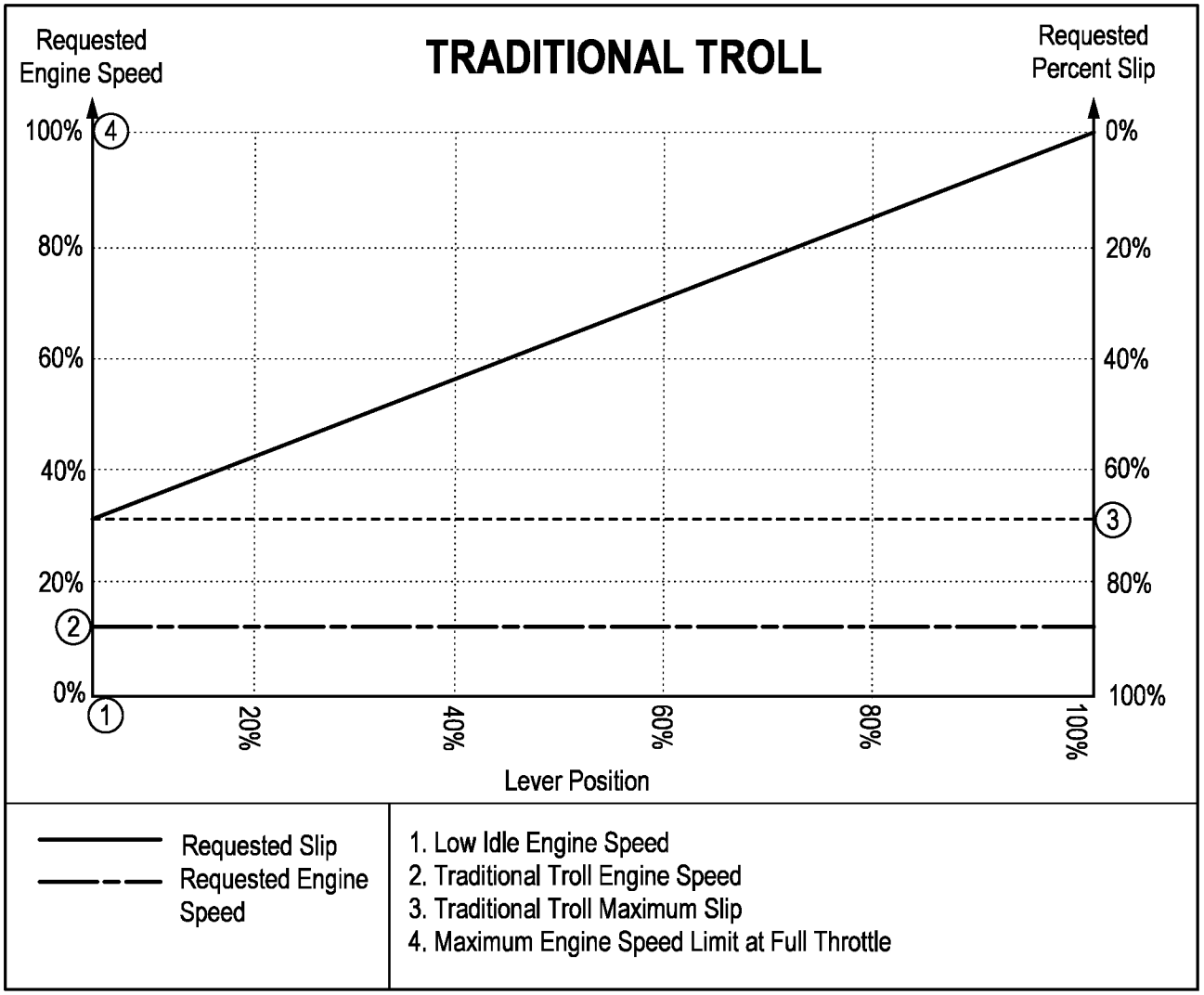
FIG. 6 is a chart illustrating the relative engine speed and troll valve position relative to lever position in a 'traditional troll mode', according to one aspect of the present disclosure.

As shown in FIG. 6, in 'traditional troll' mode, the engine speed is constant for all lever positions. The traditional troll engine speed (circle 2 in FIG. 6) may be the engine idle speed or another low speed. The engine speed should not exceed 20% of full engine throttle to prevent damage to the transmission. In some embodiments, the engine speed may be limited to 1000 rpm in troll mode. A lever position of 100% corresponds to 0% clutch slip (clutch fully engaged). A lever position of 0% may correspond to 100% slip or another maximum slip % as desired. The traditional troll maximum slip is shown by circle 3 to be less than 70% slip.

Figure 7:
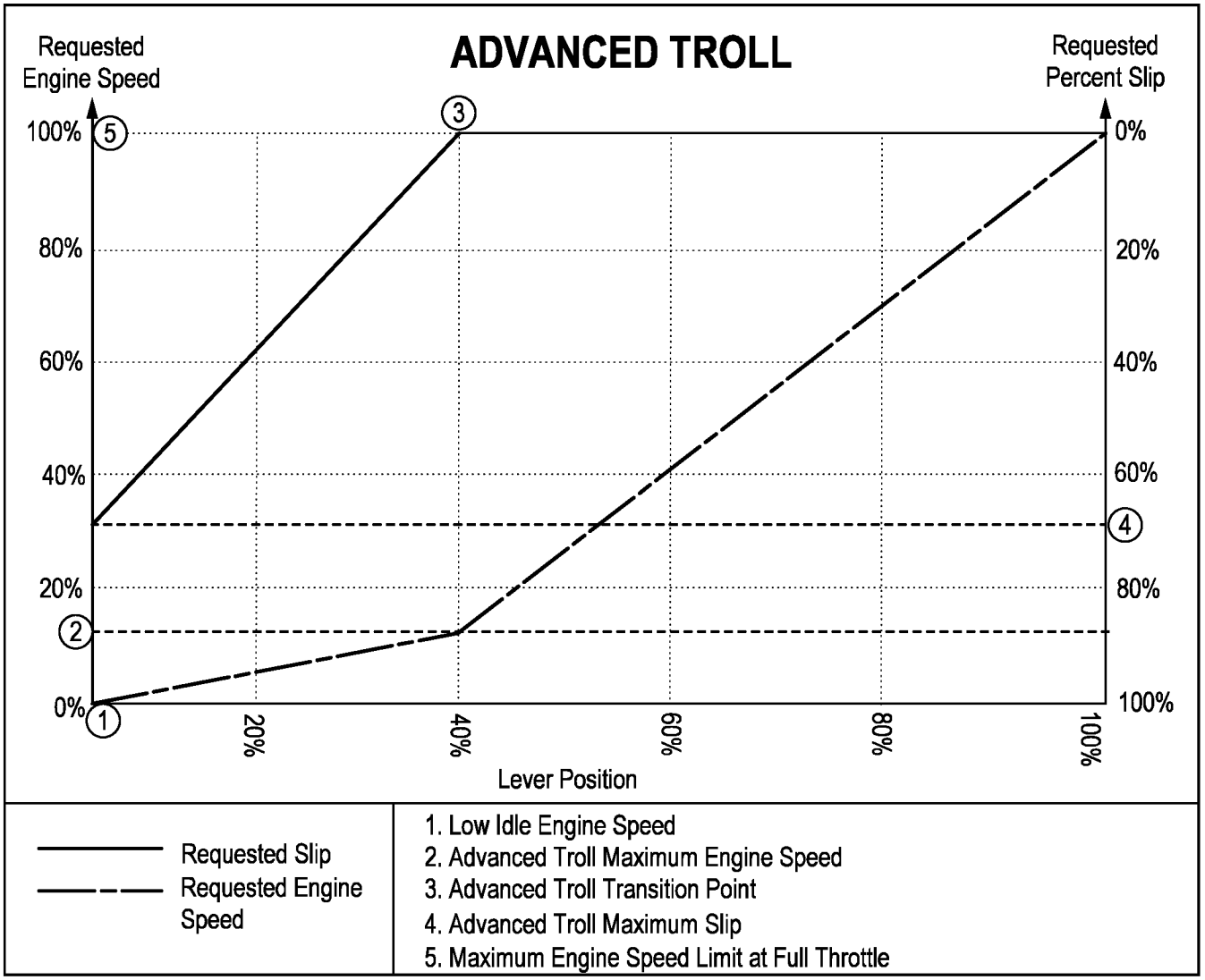
FIG. 7 is a chart illustrating the relative engine speed and troll valve position relative to lever position in an 'advanced troll mode', according to one aspect of the present disclosure.

In 'advanced troll' mode, both a 'trolling state' and a normal operating state are available within the lever position range, as illustrated in the chart of FIG. 7. From a lever position of 0% to an 'advanced troll transition point' (illustrated as 40%, see circle 3), the propulsion system 150, 155 is operating in a trolling state and the lever position controls the troll valve 360, 365. However, from the 'advanced troll transition point' to a lever position of 100%, the lever position controls the engine speed. Between lever positions 0% to the transition point, the engine speed gradually increases from the engine idle speed (circle 1) to an advanced troll maximum engine speed. The advanced troll maximum engine speed should not exceed 20% of the maximum engine throttle to prevent damage to the transmission.

'Sync' mode is not an independent mode and instead may be active in addition to any of the other modes. When 'sync' is active, both the left and the right marine propulsion systems 150, 155 are controlled together. Either the left control lever 210 or the right control lever 215 may be designated by the control module 410 or an operator as a master lever to control both propulsion systems 150, 155. Based on the designation, the control module 410 uses either the 'right lever position' or the 'left lever position' as a 'master lever position.'

During normal operation, the speed of both the left and right engine 320, 325 is synchronized to the master lever position.

In each of the trolling modes, the control system may be operating in a trolling state in which the speed of the vessel is controlled by adjusting the troll valves. A trolling state exists when the 'traditional troll' mode is active. Alternatively, a trolling state exists if the 'advanced troll' mode is active and the master lever position is less than the advanced troll transition point. If the vessel 100 is operating in a trolling state, the engine speed cannot be used to synchronize the propulsion systems 150, 155 to the master lever. Instead, the control module 410 synchronizes the left shaft speed and the right shaft speed to the master lever position. The shaft speed is controlled by adjusting the position of the corresponding troll valve.

In order to synchronize based on the shaft speed, the control module 410 determines whether the propulsion systems 150, 155 are operating in a trolling state, and whether sync mode is active. If both are true, a lever position of 0% corresponds to a shaft speed of zero and as the lever position moves towards 100%, the shaft speed increases. If the left shaft speed and the right shaft speed are not equal, the troll valve 320, 325 corresponding to the faster shaft 340, 345 is opened slightly to increase slippage and slow the shaft 340, 345.

If the vessel 100 is not in a trolling state, the synchronization is based on the engine speed as described above. If sync mode is not active, each propulsion system 150, 155 is independently operated, as previously described.

INDUSTRIAL APPLICABILITY

Figure 8:
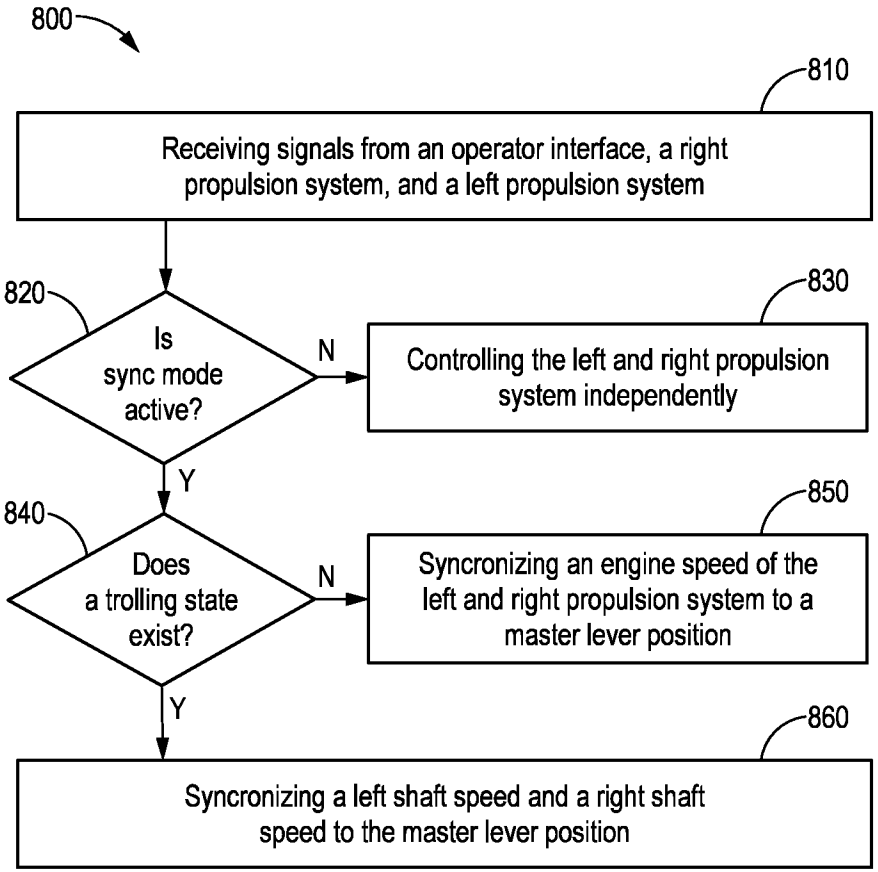
FIG. 8 is a flowchart illustrating a method of operation of a marine propulsion control system, according to one aspect of the present disclosure.

In general, the present disclosure finds application in marine propulsion control systems. More specifically, the system 400 disclosed above, may be advantageous for any machine with two or more propulsion systems intended for operation at slow speeds A method for operation of a marine propulsion control system with synchronization in a trolling state is shown in FIG. 8.

The method 800 begins in block 810. In block 810, the control module 410 receives signals from the operator interface 200 and the propulsion systems 150, 155. Based on those signals, the control module 410 determines whether sync mode is active (block 820). If sync mode is not active, the propulsion systems 150, 155 are operated independently (block 730).

In addition, the control module 410 determines whether a trolling state exists (block 840). A trolling state exists when either a) the traditional troll mode is active or b) when the advanced troll mode is active and the master lever position is below the advanced troll transition point. If a trolling state does not exist, the control module 410 synchronizes the engine speed (block 850).

If sync mode is active and a trolling state exists, the control module 410 synchronizes the left and right shaft speeds to the master lever (block 860). The shaft speeds are controlled by adjusting the position of the left and right trolling valves 360,365. If the shaft speeds are not equal, the control module 410 will command the troll valve 360, 365 of the faster shaft to open slightly until the right and left shaft 340, 345 are rotating at the same speed While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A marine vessel, comprising:

a hull;

an operator station supported by the hull having an operator interface configured to receive a mode input and a lever position input;

a left propulsion system having a left engine, a left transmission, a left troll valve configured to adjust clutch slip, a left shaft, a left shaft speed sensor configured to detect a speed of rotation of the left shaft, and a left propeller;

a right propulsion system having a right engine, a right transmission, a right troll valve configured to adjust clutch slip, a right shaft, a right shaft speed sensor configured to detect the speed of rotation of the right shaft, and a right propeller; and a control module configured to:

receive the mode input and the lever position input from the operator interface, receive signals from the left shaft sensor indicating a left shaft speed, receive signals from the right shaft sensor indicating a right shaft speed, determine if the vessel is operating in a trolling state in a traditional troll mode or an advanced troll mode, based on the mode input and the lever position input, determine if a sync mode is active, based on the mode input, if the vessel is operating in the advanced troll mode, controlling the left troll valve and the right troll valve from a lever position of 0% to an advanced troll transition point, and controlling engine speed of the left engine and the right engine from a lever position of the advanced troll transition point to 100%, and if the sync mode is active and the vessel is in the trolling state, synchronize the speed of the left shaft and the right shaft based on the left shaft speed signal and the right shaft speed signal.

2. The vessel of claim 1, wherein the trolling state exists when a speed of the vessel is controlled by adjusting the left and the right troll valves.

3. The vessel of claim 1, wherein the trolling state exists when the traditional troll mode is active or when the advanced troll mode is active and the lever position is less than the advanced troll transition point.

4. The vessel of claim 1, wherein the left and right shaft speed are synchronized to a master lever position.

5. The vessel of claim 1, wherein the left and right shaft speeds are synchronized by adjusting the left troll valve and the right troll valve to allow clutch slip.

6. The vessel of claim 1, wherein if the right shaft speed and the left shaft speed are not equal, the troll valve corresponding to the shaft rotating faster is opened until the right shaft speed and the left shaft speed are equal.

7. A marine propulsion control system, comprising:

an operator interface configured to receive a mode input and a lever position input;

a left propulsion system having a left troll valve configured to adjust clutch slippage, and a left shaft speed sensor configured to detect the speed of rotation of a left shaft;

a right propulsion system having a right troll valve configured to adjust clutch slippage, and a right shaft speed sensor configured to detect the speed of rotation of a right shaft; and a control module configured to:

receive the mode input and the lever position input from the operator interface, receive a left shaft speed signal from the left shaft speed sensor and a right shaft speed signal from the left shaft speed sensor, determine if sync mode is active, based on the mode input, determine if a trolling state exists in a traditional troll mode or an advanced troll mode, based on the mode input and the lever position input, if the advanced troll mode is active, controlling the left troll valve and the right troll valve from a lever position of 0% to an advanced troll transition point, and controlling engine speed of the left engine and the right engine from a lever position at the advanced troll transition point to 100%, and if sync mode is active and a trolling state exists, adjust the left troll valve and the right troll valve to synchronize the speed of the left shaft and the right shaft based on the left shaft speed signal and the right shaft speed signal.

8. The control system of claim 7, wherein the left and right shaft speeds are synchronized to a master lever position.

9. The control system of claim 7, wherein if the right shaft speed and the left shaft speed are not equal, the troll valve corresponding to the faster shaft speed is opened until the right shaft speed and the left shaft speed are equal.

10. The control system of claim 7, wherein the trolling state exists when the left propulsion system and the right propulsion system are controlled by adjusting the troll valves.

11. The control system of claim 7, wherein the trolling state exists when the traditional troll mode is active or when the advanced troll mode is active and the lever position is less than the advanced troll transition point.

12. The control system of claim 7, wherein, if the trolling state does not exists, a left engine speed and a right engine speed are synchronized.

13. The control system of claim 7, wherein if sync mode is not active, the left propulsion system and the right propulsion system are operated independently.

14. A method of operating a marine propulsion system, comprising:

receiving a plurality of signals from an operator interface, the plurality of signals including a mode input and a lever position;

receiving a 'left shaft speed' signal indicating a left shaft speed and a 'right shaft speed' signal indicating a right shaft speed;

determining if a sync mode is active based on the mode input signal;

determining if a trolling state in a traditional troll mode or an advanced troll mode exists based on the mode input and the lever position;

if the advanced troll mode is active, controlling the left troll valve and the right troll valve when the lever position is between 0% and an advanced troll transition point, and controlling an engine speed when the lever position is between the advanced troll transition point and 100%; and if a sync mode is active and a trolling state exists, synchronizing the left shaft speed and the right shaft speed to the lever position.

* * * * *